US006497338B1

(12) United States Patent
Stolzman

(10) Patent No.: US 6,497,338 B1
(45) Date of Patent: Dec. 24, 2002

(54) PLASTIC DRUM WITH REINFORCED SIDEWALL

(76) Inventor: Michael D. Stolzman, c/o International Precision Components, 28468 N. Ballard Dr., Lake Forest, IL (US) 60045

( * ) Notice: Subject to any disclaimer, the term of this patent is extended or adjusted under 35 U.S.C. 154(b) by 62 days.

(21) Appl. No.: 09/639,036

(22) Filed: Aug. 15, 2000

(51) Int. Cl.[7] ..... B65D 90/12
(52) U.S. Cl. ..... 220/628; 220/605; 220/606
(58) Field of Search ..... 220/62.18, 652, 220/628, 650, 633, 635, FOR 181, 605, 606, 608; 229/400, 403, 404; 206/519, 520

(56) References Cited

U.S. PATENT DOCUMENTS

| | | | | | |
|---|---|---|---|---|---|
| 792,029 | A | * | 6/1905 | Harker | 220/635 |
| 2,686,610 | A | * | 8/1954 | Sharpnack, Sr. | 220/635 |
| 3,009,603 | A | * | 11/1961 | Stockdale | 220/675 |
| 3,529,743 | A | * | 9/1970 | Ehrbar et al. | 220/659 |
| 3,934,747 | A | * | 1/1976 | Needt | 220/675 |
| 4,925,049 | A | * | 5/1990 | Przytulla | 220/675 |
| 4,982,860 | A | * | 1/1991 | Dinsmoor et al. | 220/633 |
| 5,018,642 | A | * | 5/1991 | Pyzytulla | 220/675 |
| 5,180,076 | A | * | 1/1993 | Hundt | 220/62.18 |
| 5,425,454 | A | * | 6/1995 | Przytulla et al. | 206/508 |
| 5,607,075 | A | * | 3/1997 | Burgdorf et al. | 220/319 |
| 5,638,983 | A | * | 6/1997 | Bazany | 220/650 |
| 5,713,512 | A | * | 2/1998 | Barrett | 220/62.18 |
| 6,047,847 | A | * | 4/2000 | Scott | 215/373 |

FOREIGN PATENT DOCUMENTS

| | | | | |
|---|---|---|---|---|
| GB | 240079 | * | 9/1925 | 220/635 |
| GB | 2018974 | * | 10/1979 | 220/FOR 181 |

* cited by examiner

*Primary Examiner*—Stephen P. Garbe
*Assistant Examiner*—Joseph C. Merek
(74) *Attorney, Agent, or Firm*—Wood, Phillips, Katz, Clark & Mortimer

(57) ABSTRACT

A unitary plastic open head drum includes a first cylindrical sidewall closed at a bottom end with a bottom wall and open at an upper end. A second generally cylindrical sidewall is concentric to and extending at least partially the length of the first sidewall, providing sufficient stiffness to resist "elephant footing" of a bottom drum in a stack of drums.

12 Claims, 2 Drawing Sheets

PLASTIC DRUM WITH REINFORCED SIDEWALL

FIELD OF THE INVENTION

This invention relates to containers and, more particularly, to an injection molded plastic drum with a reinforced sidewall.

BACKGROUND OF THE INVENTION

In one form of a conventional shipping and storage container, an enlarged drum is used. The drum may be, for example, a fifty five gallon drum. Such drums have found wide usage for shipping and storing liquid or granular products. For example, such drums have been used for storing food products and for storing hazardous products.

In its simplest form, a drum includes a single tubular sidewall closed at one end by a bottom wall. Such containers typically have either a fiberboard or metal sidewall of uniform thickness. More recently, plastic drums have found wide acceptance.

During shipping and storage, such plastic drums are often stacked to conserve space. When filled plastic drums are stacked, however, the additional weight bearing on a bottom drum in a stack may cause significant deformations of the bottom drum. In such a case, a lower portion of the bottom drum typically bulges outwards. resulting in an "elephant foot" shaped bottom drum. This deformation produces an internal pressure within the bottom drum, forcing the contents of the bottom drum to escape.

The present invention is intended to solve one or more problems discussed above in a novel and simple manner.

SUMMARY OF THE INVENTION

In accordance with the invention there is provided a unitary plastic drum.

Broadly, there is disclosed herein a plastic shipping container including a unitary plastic drum having a generally cylindrical sidewall closed at a bottom end with a bottom wall and open at an upper end. The drum is of one-piece plastic construction.

It is a feature of the invention that at a lower section of the sidewall is double-walled.

It is another feature of the invention that a center section of the drum includes a diameter that decreases from the drum top downwards.

It is another feature of the invention that an upper section of the drum have a greater diameter than a diameter of the center section, thereby creating a conical ledge on the inner surface of the drum.

It is another feature of the invention that the lower section has a smaller diameter than the center section diameter such that a ledge is formed to aid in the nesting of empty drums.

It is yet another feature of the invention to include a second cylindrical sidewall concentric to and extending at least partially the length of the first sidewall.

DETAILED DESCRIPTION OF THE INVENTION

Figure 1:
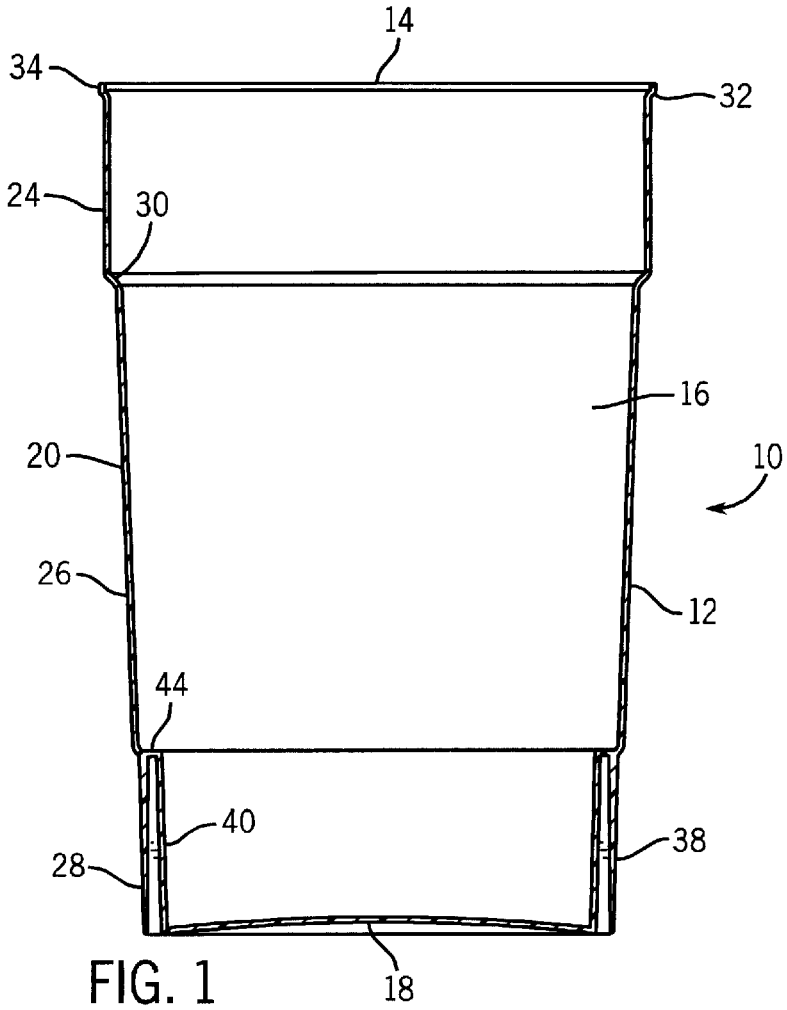
FIG. 1 is a sectional view of a unitary plastic open head drum taken along the line 1—1 of FIG. 2.

In the illustrated embodiment of the invention, as disclosed in the drawings, a container 10 is shown to comprise a unitary open head plastic drum 12 with an open top end 14. The drum is formed of a suitable material, such as a molded synthetic resin. Advantageously, the resin is a thermoplastic which is suitable for injection molding.

With reference to FIG. 1, the drum 12 has a generally cylindrical sidewall 16 connected to a bottom wall 18 to define an interior space 20. The drum 12 is open at the top end 14. The sidewall 16 is approximately thirty seven inches tall, and includes an upper section 24, a middle section 26, and a lower section 28. The upper section 24 and middle section 26 have a uniform wall thickness of approximately one quarter inch. The upper section 24 has a uniform diameter of approximately twenty four inches and connects to the middle section 26, which is of a smaller diameter, forming a conical ledge 30. The middle section 26 has a downwardly decreasing diameter, such that the sidewall 16 forms an angle of approximately two degrees with the vertical at the middle 10 section 26. At the open end 14, the upper section 24 includes a radially outwardly extending flange 32 which in turn is connected to an upwardly extending cylindrical lip 34 The cylindrical lip 34 forms a seal between the open end 22 and a cover (not shown).

Figure 2:
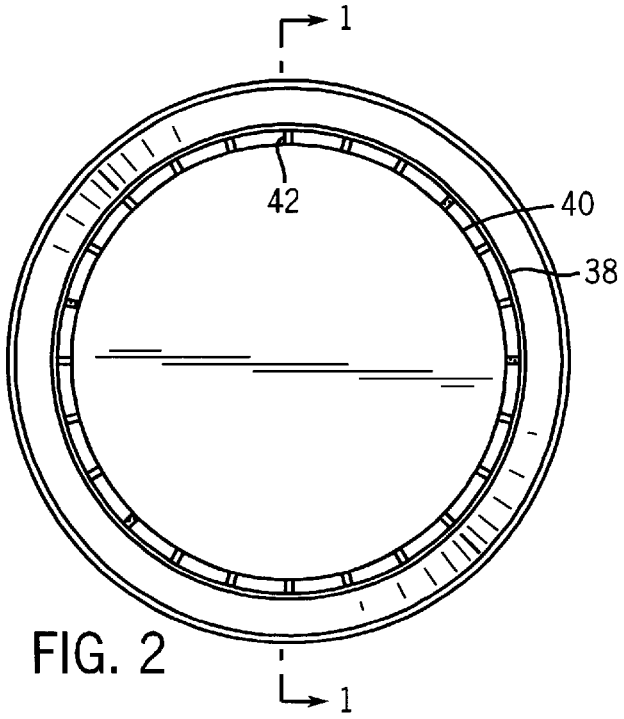
FIG. 2 is a bottom plan view of the drum shown in FIG. 1.

The lower section 28 of the drum 12 includes an outer sidewall 38 with a diameter of approximately twenty inches and an inner sidewall 40 with a smaller diameter than the diameter of the outer sidewall 38. With reference to FIG. 2, the lower section 28 is comprised of a plurality of radially extending ribs 42 sandwiched between the outer sidewall 38 and the inner sidewall 40. The ribs 42 are circumferentially spaced with a major axis aligned substantially parallel to the longitudinal axis of the lower section 28. The outer sidewall 38 has a downwardly decreasing thickness, whereas the inner sidewall 40 has a uniform thickness of approximately one quarter inch. The outer sidewall 38 and the inner sidewall 40 are approximately eight inches tall. The outer sidewall 38 of the lower section 28 has a diameter slightly less than a diameter of the bottom of the middle section 26. An annular lip 43 connects the top of the inner sidewall 40 with the top of the outer sidewall 38, forming an interior ledge 44 within the drum 12. The bottom wall 18 has a uniform thickness of approximately one quarter inch and connects to the inner sidewall 40 of the lower section 28.

The present invention sufficiently prevents "elephant footing" of the drum, and presents many advantages over the use of a conventional single sidewall lower section construction. To achieve an equivalent stiffness of the present double sidewall invention, a single sidewall lower section would have a thickness of at roughly one half inch. Such a thickness would require a greater amount of material than the present invention, thus increasing the drum weight and cost. Furthermore, a single sidewall with a one half inch thickness may be difficult to mold. The present invention overcomes these difficulties by exploiting a laminated construction wherein support ribs are sandwiched between two concentric sidewalls. More specifically, less material is used in the lower sidewall construction of the present invention since hollow cavities are formed between adjacent support ribs. Additionally, the structure exhibits good moldability since the inner and outer walls have a thickness that is typical in the conventional art.

Figure 3:
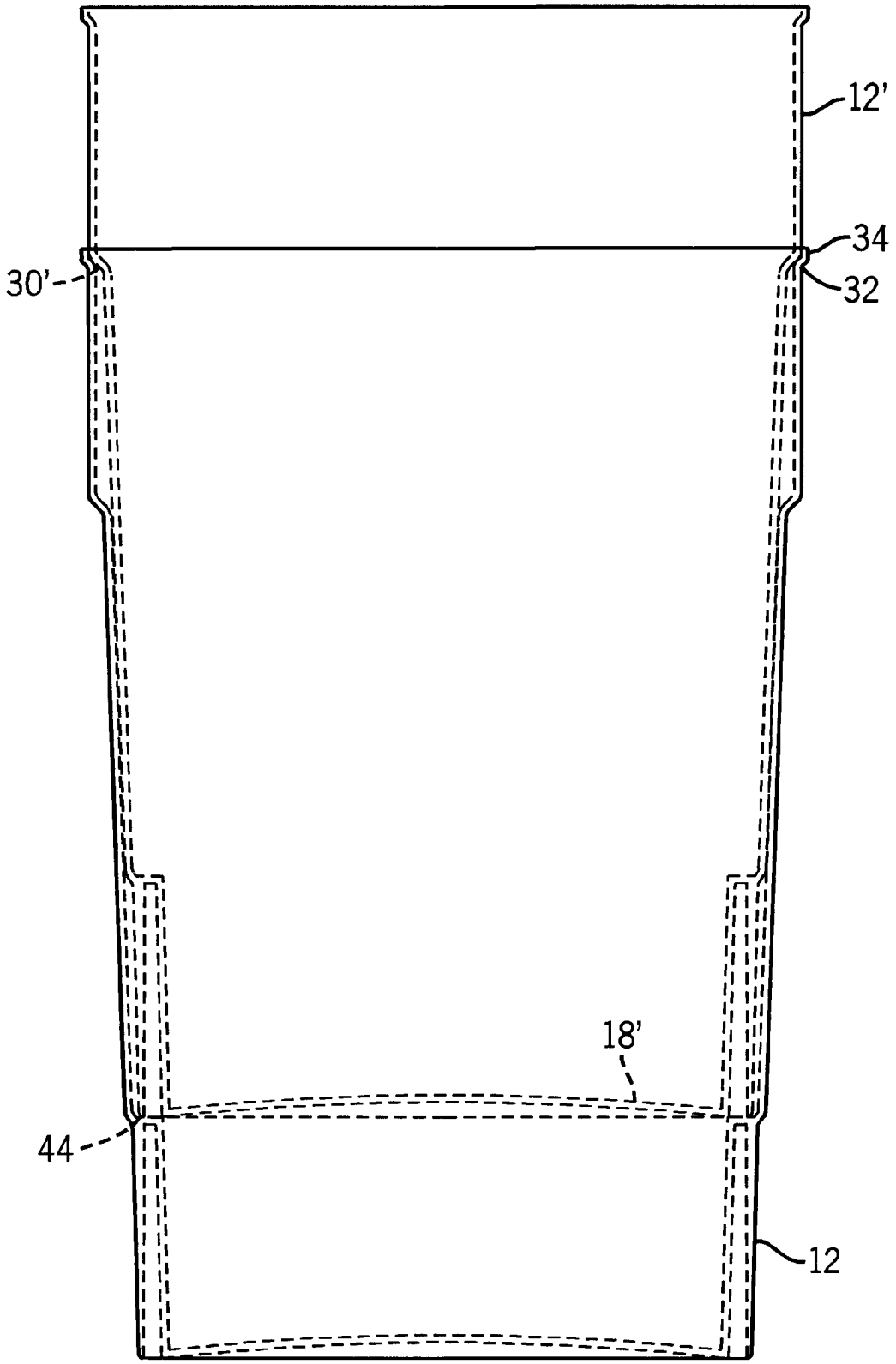
FIG. 3 is a sectional view of a nested drum configuration.

To conserve space during shipping and storage, a plurality of empty drums are often nested within one another. As shown in FIG. 3, a drum 12' identical to the drum 12 may be nested within the drum 12. The bottom wall 18' of the drum 12' rests upon the interior ledge 44 of the drum 12. Additionally, the exterior conical ledge 30' of the drum 12' rests upon the radially outwardly extending flange 32 and within the cylindrical lip 34 of the drum 12.

I claim:

1. A unitary molded plastic drum comprising:

a generally cylindrical sidewall connected to a bottom wall to define an interior space, the cylindrical sidewall having an upper section, a middle section and a lower section, the upper section and middle section having a uniform wall thickness, the lower section including an outer sidewall and an inner sidewall and a plurality of radially extending ribs sandwiched between and connecting the outer sidewall and the inner sidewall and an annular lip connecting a top of the inner sidewall with a top of the outer sidewall and forming an interior ledge within the interior space and said outer wall tapering from a thicker portion adjacent said lip to a thinner portion adjacent said bottom.

2. The drum of claim 1 wherein the middle section is inwardly inclined.

3. The drum of claim 2 wherein a diameter of the middle section is less than a diameter of the upper section, forming a conical ledge on an inner surface of said sidewall.

4. The drum of claim 3 wherein a diameter of the lower section is less than a diameter of the middle section.

5. The drum of claim 1 wherein the lower section outer sidewall has a thickness which increases downwardly from the lip to a bottom edge.

6. The drum of claim 5 wherein the lower section inner sidewall has a uniform thickness.

7. A unitary molded plastic drum comprising:

a first generally cylindrical sidewall connected at a bottom edge to a bottom wall to define an interior space, and having an upper section, a middle section and a lower section, separated by upper and lower ledges; and a second generally cylindrical sidewall extending downwardly from the lower ledge concentric with the first generally cylindrical sidewall lower section to define a downwardly opening space therebetween; and a plurality of circumferentially spaced support ribs connected between said first sidewall and said second sidewall in said downwardly opening space and said outer wall tapering from a thicker portion adjacent said lip to a thinner portion adjacent said bottom.

8. The drum of claim 7 wherein the middle section is inwardly inclined.

9. The drum of claim 8 wherein a diameter of the middle section is less than a diameter of the upper section, forming a conical upper ledge on an inner surface of said first sidewall.

10. The drum of claim 9 wherein a diameter of the lower section is less than a diameter of the middle section.

11. The drum of claim 7 wherein the lower section outer sidewall has a thickness which increases downwardly from the lip to a bottom edge.

12. The drum of claim 11 wherein the first sidewall lower section has a uniform thickness.

* * * * *